US006939112B2

(12) United States Patent
Taguchi

(10) Patent No.: US 6,939,112 B2
(45) Date of Patent: Sep. 6, 2005

(54) VARIABLE DISPLACEMENT COMPRESSORS

(75) Inventor: Yukihiko Taguchi, Isesaki (JP)

(73) Assignee: Sanden Corporation, Gunma (JP)

( * ) Notice: Subject to any disclaimer, the term of this patent is extended or adjusted under 35 U.S.C. 154(b) by 306 days.

(21) Appl. No.: 10/421,837

(22) Filed: Apr. 24, 2003

(65) Prior Publication Data

US 2003/0202885 A1 Oct. 30, 2003

(30) Foreign Application Priority Data

Apr. 25, 2002 (JP) ..... 2002-124363

(51) Int. Cl.[7] ..... F04B 1/26
(52) U.S. Cl. ..... 417/222.2; 62/228.5
(58) Field of Search ..... 417/222.2; 62/228.5

(56) References Cited

U.S. PATENT DOCUMENTS

| | | | | |
|---|---|---|---|---|
| 4,780,060 | A | 10/1988 | Terauchi | |
| 4,842,488 | A | 6/1989 | Terauchi | |
| 4,874,295 | A | 10/1989 | Kobayashi et al. | |
| 4,878,817 | A | 11/1989 | Kikuchi et al. | |
| 5,051,067 | A | 9/1991 | Terauchi | |
| 5,165,863 | A | 11/1992 | Taguchi | |
| 5,242,274 | A | 9/1993 | Inoue | |
| 5,336,058 | A | 8/1994 | Yokoyama | |
| 5,425,303 | A | 6/1995 | Shimizu | |
| 5,490,767 | A | 2/1996 | Kanou et al. | |
| 5,993,171 | A | 11/1999 | Higashiyama | |
| 6,056,514 | A | 5/2000 | Fukai | |
| 6,099,276 | A | 8/2000 | Taguchi | |
| 6,102,669 | A | 8/2000 | Fujita | |
| 6,102,670 | A | 8/2000 | Taguchi | |
| 6,129,519 | A | 10/2000 | Ogura | |
| 6,179,572 | B1 | 1/2001 | Taguchi | |
| 6,196,808 | B1 | 3/2001 | Taguchi | |
| 6,254,356 | B1 * | 7/2001 | Yamada et al. | 417/222.2 |
| 6,354,811 | B1 * | 3/2002 | Ota et al. | 417/222.2 |
| 6,443,708 | B1 * | 9/2002 | Hirota | 417/222.2 |
| 6,578,465 | B2 | 6/2003 | Tagami | |

FOREIGN PATENT DOCUMENTS

| | | |
|---|---|---|
| EP | 1167759 | 1/2002 |
| JP | 6332933 | 2/1988 |
| JP | 2000283028 | 10/2000 |

* cited by examiner

*Primary Examiner*—Charles G Freay
(74) *Attorney, Agent, or Firm*—Baker Botts L.L.P.

(57) ABSTRACT

A variable displacement compressor includes a suction chamber, a discharge chamber, and a crank chamber. The compressor also includes a first path for allowing communication between the crank chamber and the discharge chamber, and a second path for allowing communication between the crank chamber and the suction chamber. Moreover, the compressor includes a valve assembly. The valve assembly includes a valve positioned within the first path, and the valve assembly controls a pressure in the crank chamber by varying a position of the valve. The compressor also includes an orifice mechanism. The orifice mechanism includes a plate having a hole formed therethrough, and an elongated member positioned within the hole. Specifically, the elongated member is movable within the hole, and an annulus of the orifice mechanism is defined between the elongated member and an interior surface of the hole. Moreover, the annulus defines a portion of the second path, and the orifice mechanism controls a flow of a refrigerant from the crank chamber to the suction chamber by varying an area of the annulus. The compressor also includes a linking member operationally coupling the valve assembly to the orifice mechanism. For example, the linking member may operationally couple the valve assembly to the orifice mechanism, such that when the area of the opening of the annulus is at a minimum area, the valve may be open, and when the area of the opening of the annulus is at a maximum area, the valve may be closed.

16 Claims, 5 Drawing Sheets

VARIABLE DISPLACEMENT COMPRESSORS

BACKGROUND OF THE INVENTION

1. Field of the Invention

The present invention relates generally to variable displacement compressors. In particular, the present invention is directed towards variable displacement compressors in which a valve assembly is operationally coupled to a orifice mechanism to control a pressure within a crank chamber of the compressor.

2. Description of Related Art

Known variable displacement compressors, used in automobiles, such as the compressor described in Japanese Publication No. JP-Y S63-32933, include a swash plate or a cam plate positioned within a crank chamber, and a piston which reciprocates within a cylinder bore. An inclination angle of the plate varies in response to a pressure in the crank chamber, and the inclination angle determines a stroke length of the piston. Specifically, when the pressure in the crank chamber increases, the inclination angle and the stroke length of the piston decreases. Similarly, when the pressure in the crank chamber decreases, the inclination angle and the stroke length of the piston increases. Moreover, when the piston moves away from the suction chamber, the piston draws a refrigerant, e.g., a liquid refrigerant or a refrigerant gas, from the suction chamber into the cylinder bore. Similarly, when the piston moves toward the suction chamber, the piston compresses the refrigerant within the cylinder bore, and discharges the compressed refrigerant into a discharge chamber.

Such known compressors also include a first path which allows refrigerant communication between the crank chamber and the discharge chamber, and a second path which allows refrigerant communication between the crank chamber and the suction chamber. Moreover, a valve assembly controls the flow of refrigerant within the first path, and an orifice mechanism controls the flow of refrigerant within the second path. When a valve of the valve assembly is open, the compressed refrigerant inside the discharge chamber flows into the crank chamber, and the inclination angle decreases. Similarly, when the area of an opening of an annulus of the orifice mechanism increases, the refrigerant flows from the crank chamber to the suction chamber, and the inclination angle also increases.

In the known compressors, the area of the opening of the annulus and the rate at which the refrigerant flows from the crank chamber to the suction chamber depends on a difference between the pressure in the suction chamber and the pressure in the discharge chamber. Specifically, when the difference between the pressure in the suction chamber and the pressure in the discharge chamber increases, the rate at which the refrigerant flows from the crank chamber to the suction chamber increases. Similarly, when the difference between the pressure in the suction chamber and the pressure in the discharge chamber decreases, the rate at which the refrigerant flows from the crank chamber to the suction chamber decreases. Nevertheless, when the difference between the pressure in the suction chamber and the pressure in the discharge chamber is less than a predetermined pressure differential, the area of the opening of the annulus is closer to the minimum area than the maximum area, and the inclination angle is less than a predetermined inclination angle. When a user of the automobile then signals to decrease a temperature within the automobile from an actual temperature to a predetermined temperature, the difference between the pressure in the suction chamber and the pressure in the discharge chamber increases, e.g., because the crank chamber pressure decreases. As such, the inclination angle also increases, and the area of the opening of the annulus increases. Nevertheless, a predetermined amount of time expires before the inclination angle increases to the predetermined inclination angle, and the area of the opening of the annulus increases to the maximum area. Consequently, the predetermined amount of time expires before a temperature of air dispensed from the compressor is about equal to the predetermined temperature.

SUMMARY OF THE INVENTION

Therefore, a need has arisen for variable displacement compressors which overcome these and other shortcomings of the related art. A technical advantage of the present invention is that the amount of time which elapses before the compressor dispenses air having a temperature which is about equal to the predetermined temperature is less than the predetermined amount of time.

In an embodiment of the present invention, a variable displacement compressor comprises a suction chamber, a discharge chamber, and a crank chamber. The compressor also comprises a first path for allowing communication between the crank chamber and the discharge chamber, and a second path for allowing communication between the crank chamber and the suction chamber. For example, with reference to FIGS. 1 and 2, the first path may comprise a first passage 71, a second passage 72, a hollow portion 45, a first through hole 57*c*, a first port 23, a second chamber 17, a second through hole 20, and a second port 24, and the second path may comprise first passage 71, hollow portion 45, first through hole 57*c*, first port 23, second chamber 17, a third passage 73, a third through hole 21*a*, a first chamber 16, a third chamber 18, a fourth passage 19, and a third port 26. Moreover, the compressor comprises a valve assembly. The valve assembly comprises a valve positioned within the first path, and the valve assembly controls a pressure in the crank chamber by varying a position of the valve. The compressor also comprises an orifice mechanism. The orifice mechanism comprises a plate having a hole formed therethrough and an elongated member positioned within the hole. Specifically, the elongated member is movable within the hole, and an annulus of the orifice mechanism is defined between the elongated member and an interior surface of the hole. Moreover, the annulus defines a portion of the second path, and the orifice mechanism controls a flow of a refrigerant from the crank chamber to the suction chamber by varying an area of an opening of the annulus. The compressor also comprises a linking member operationally coupling the valve assembly to the orifice mechanism. For example, the linking member may operationally couple the valve assembly to the orifice mechanism, such that when the area of the opening of the annulus is at a minimum area, the valve may be open, and when the area of the opening of the annulus is at a maximum area, the valve may be closed.

Other objects, features, and advantage will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings.

DETAILED DESCRIPTION OF PREFERRED EMBODIMENTS

Preferred embodiments of the present invention and their features and advantages may be understood by referring to FIGS. 1–7, like numerals being used for like corresponding parts in the various drawings.

Figure 1:
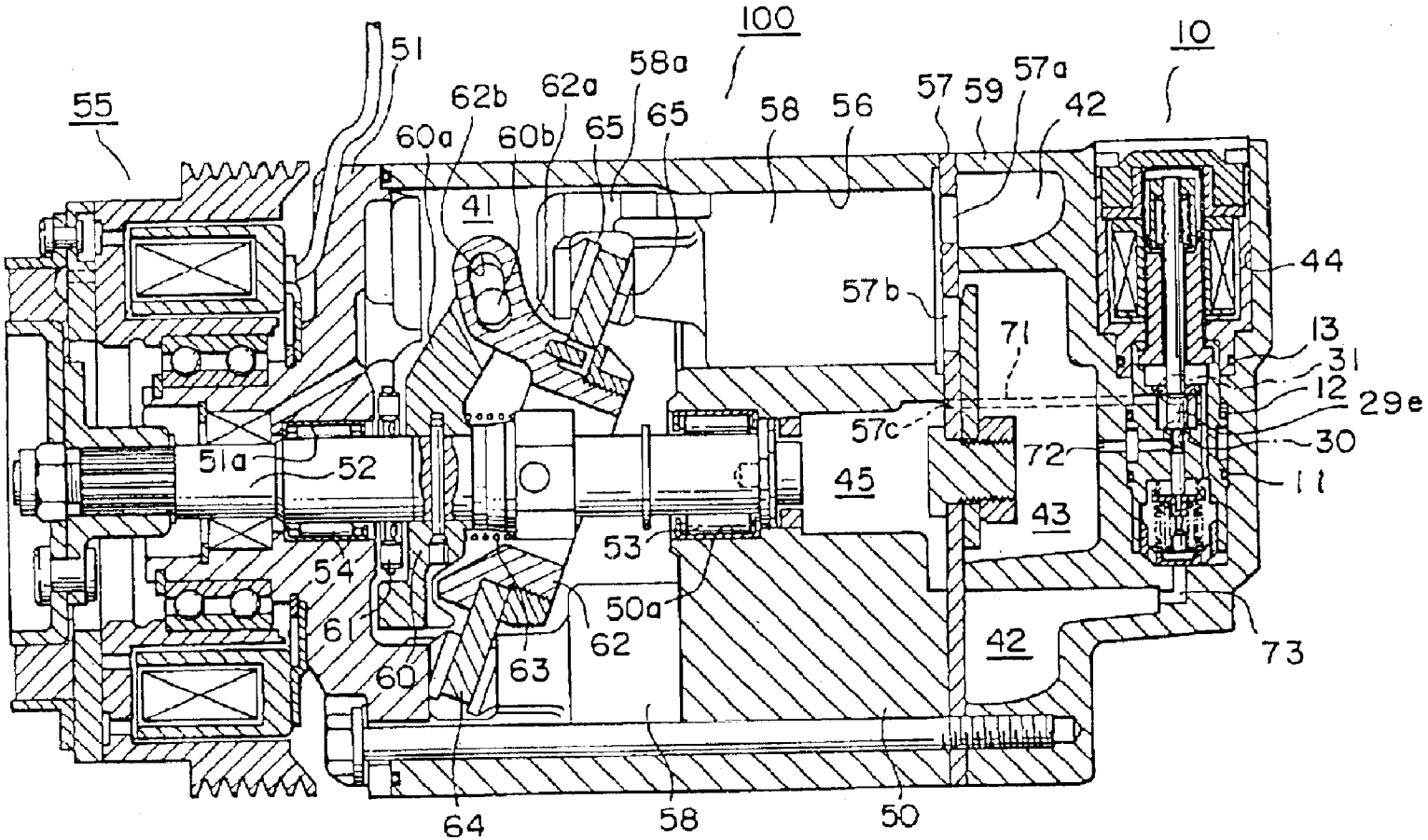
FIG. 1 is a cross-sectional view of a variable displacement compressor according to an embodiment of the present invention.

Referring to FIG. 1, a variable displacement compressor 100 according to an embodiment of the present invention is depicted. Compressor 100 may comprise a cylinder block 50 and a front housing 51 fixed to a front end of the cylinder block 50. Cylinder block 50 and front housing 51 may define a crank chamber 41. Cylinder block 50 and front housing 51 each may have a center hole 50*a* and 51*a* formed therethrough, respectively. Cylinder block 50 and front housing 51 also may support a drive shaft 52 via a pair of radial bearings 53 and 54 positioned within center holes 50*a* and 51*a*, respectively. Drive shaft 52 extends in an axial direction within compressor 100, and one end of drive shaft 52 penetrates front housing 51 and is connected to an electromagnetic clutch 55. Electromagnetic clutch 55 transmits a rotational force from a driving source, e.g. an engine an engine of a vehicle, to drive shaft 52.

Cylinder block 50 may have a plurality of cylinder bores 56 formed therein, and cylinder bores 56 may extend in an axial direction toward crank chamber 41. In an embodiment, compressor 100 may comprise an odd number of cylinder bores, e.g., seven cylinder bores. Compressor 100 also may comprise a plurality of pistons 58, and each piston 58 may be positioned within a corresponding one of cylinder bores 56, such that each piston 58 reciprocates independently within their corresponding cylinder bore 56 Moreover, a valve plate 57 may be fixed to cylinder block 50 to enclose each piston 58 within their corresponding cylinder bore 56. Valve plate 57 may have a suction port 57*a* and a discharge port 57*b* formed therethrough, and a rear housing 59 may be fixed to valve plate 57. A suction chamber 42 and a discharge chamber 43 may be formed within rear housing 59, and suction chamber 42 and discharge clamber 43 may be in refrigerant communication with cylinder bores 56 via suction port 57*a* and discharge port 57*b*, respectively.

Compressor 100 also may comprise a rotor 60 mounted on drive shaft 52. Rotor 60 may be positioned within crank chamber 41, and rotates when drive shaft 52 rotates. Front housing 51 may support rotor 60 via a thrust bearing 61. Rotor 60 may comprise a first tab portion or a first arm portion 60*a* and a pin 60*b*. A boss 62 may be mounted on drive shaft 52, and an inclination angle of boss 62 may be varied. Boss 62 may comprise a second tab portion or a second arm portion 62*a* having a hole 62*b* formed therethrough. Pin 60*b* may be positioned within hole 62*b* and is movable within hole 62*b*. A spring 63 may be positioned between the rotor 60 and boss 62, and a swash plate 64 may be fixed to boss 62, such that swash plate 64 is supported by boss 62, and an inclination angle of swash plate 64 varies with the inclination angle of boss 62. Compressor 100 also may comprise a plurality of shoe pairs 65, and a peripheral portion of swash plate 64 may be positioned between a first and a second shoe of shoe pair 65. Shoes pairs 65 may be supported by shoe supporters 58*a* which are formed integrally with pistons 58, and each shoe 65 may slide on an inner surface of a corresponding one of shoe supporters 58*a*. Thus, swash plate 64 may be coupled to pistons 58 via shoes pairs 65. When drive shaft 52 rotates, swash plate 64 also rotates. Moreover, swash plate 64 slides between shoe pairs 65, and pistons 58 reciprocate within their corresponding cylinder bore 56.

The inclination angle of swash plate 64 may be controlled by the pressure within crank chamber 41, such that a stroke of each pistons 58 also is controlled by the pressure within crank chamber 41. Specifically, compressor 100 may comprise a control valve assembly 10 for controlling the inclination angle of swash plate 64. Control valve assembly 10 may be positioned within a cavity 44 formed within rear housing 59. Moreover, a first passage 71, a second passage 72, and a third passage 73 may be formed through rear housing 59. Specifically, a hollow portion 45 may be formed within cylinder block 50 adjacent to a rear of drive shaft 52, and a through hole 57*c* may be formed through valve plate 57. First passage 71 may allow refrigerant communication between cavity 44 and hollow portion 45 via through hole 57*c*. Moreover, hollow portion 45 may be in refrigerant communication with crank chamber 41 via a gap formed between drive shaft 52 and radial bearing 53. Second passage 72 may allow refrigerant communication between cavity 44 and discharge chamber 43, and third passage 73 may allow refrigerant communication between cavity 44 and suction chamber 42. Further, first passage 71, second passage 72, and third passage 73 may be isolated from each other by a plurality of O-rings 11–13 which are fitted around control valve assembly 10.

Figure 2:
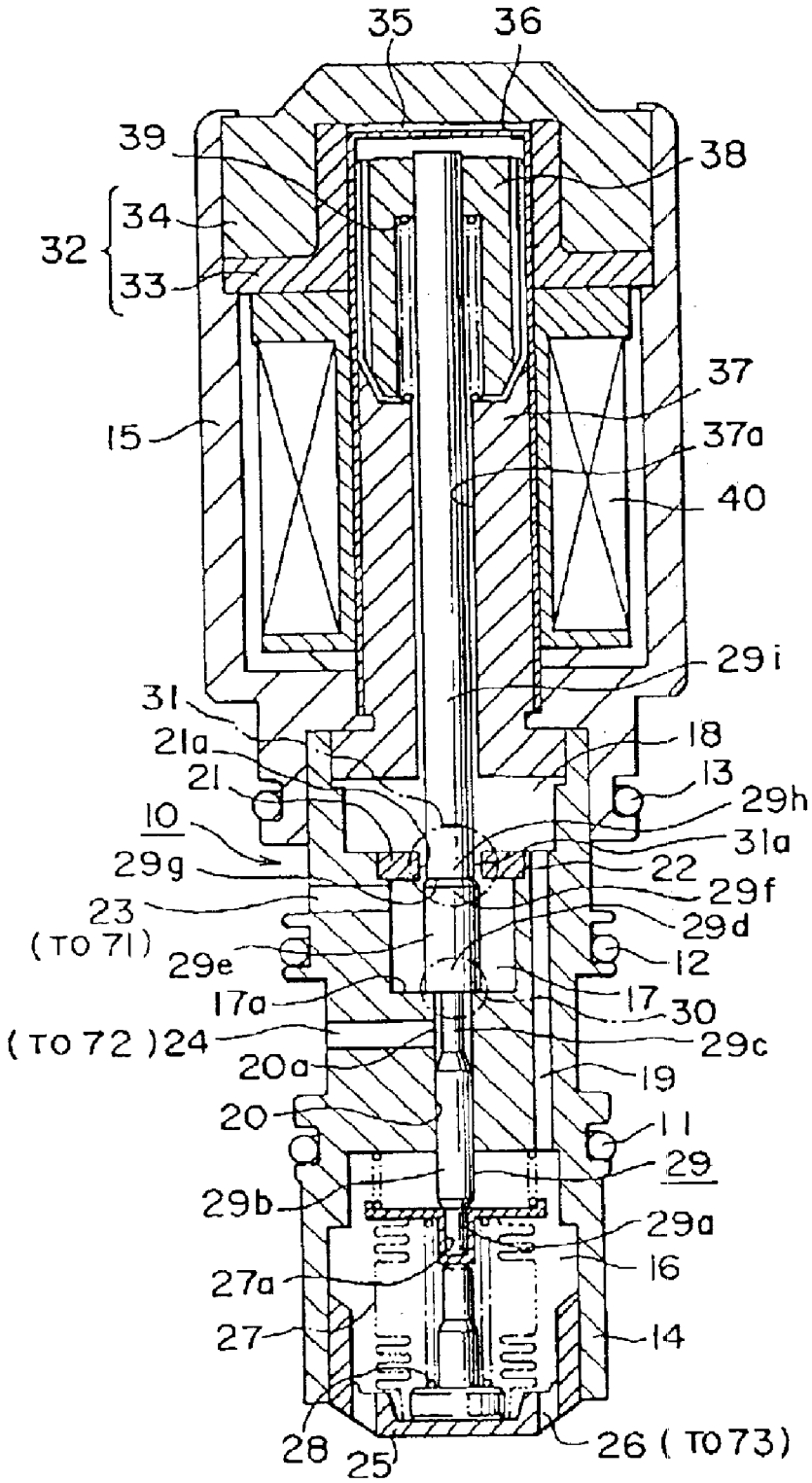
FIG. 2 is a cross-sectional view of a valve assembly of the compressor of FIG. 1

Referring to FIG. 2, control valve assembly 10 may comprise a first casing 14 and a second casing 15 fixed to first casing 14. First casing 14 may have a first chamber 16, a second chamber 17, and a third chamber 18 formed therein. First chamber 16 and third chamber 18 may be in communication via a fourth passage 19, and first chamber 16 and second chamber 17 may be in communication via a through hole 20 formed through first casing 14. Through hole 20 may be positioned on a center axis of control valve assembly 10. A separation plate 21 having a through hole 21*a* formed therethrough may be positioned between second chamber 18 and third chamber 19, and through hole 21*a* may be aligned with through hole 20. Separation plate 21 may be fixed to an annular recess 22, and annular recess 22 may be formed in first casing 14 and positioned between second chamber 17 and the third chamber 18. First casing 14 also may have a first port 23 and a second port 24 formed therein, which may be in communication with first passage 71 and second passage 72, respectively. Moreover, first port 23 may be in communication with second chamber 17, and second port 24 may be in communication with first chamber 16 via through hole 20.

In this embodiment of the present invention, first chamber 16 may be scaled by an adjustment member 25, e.g., a lid screw. Adjustment member 25 may have a third port 26 formed therein, and third port 26 may be in communication with third passage 73, such that a pressure in first chamber 16 is about equal to the pressure in suction chamber 42. A first end of a pressure-sensitive member 27, such as a bellow, a diaphragm, or the like, may be fixed to an interior surface of adjustment member 25. Moreover, a coil spring 28 may be positioned inside pressure-sensitive member 27, and the inside of pressure-sensitive member 27 may be maintained under vacuum. Specifically, pressure-sensitive member 27 expands or contracts depending on the pressure within suction chamber 42, e,g., expands when the pressure within suction chamber 42 increases, and contracts when the pressure within suction chamber 42 decreases. A second end of pressure-sensitive member 27 may have an opening 27*a* formed therein, and a first portion 29*a* of a rod member 29 may be positioned within opening 27*a*. A second portion 29*b* of rod member 29 may be connected to first portion 29*a* via through hole 20. Second portion 29*b* may have a diameter which is about equal to a diameter of through hole 20. Second portion 29*b* also may be connected to a third portion 29*c* of rod member 29. Third portion 29*c* may have a diameter which is less than the diameter of second portion 29*b*, such that a gap 20*a* is defined between third portion 29*c* and through hole 20. Gap 20*a* may be in communication with second port 24. Moreover, third portion 29*c* may be connected to a fourth portion/valve body 29*d* of rod member 29, and a bottom surface of second chamber 17 may be a valve seat 17*a*. Valve body 29*d* may have a diameter which is greater than the diameter of through hole 20, and a valve 30 may comprise valve body 29*d* and valve seat 17*a*. First portion 29*a*, second portion 29*b*, and third portion 29*c* couple pressure-sensitive member 27 to valve 30. Specifically, when pressure-sensitive member 27 expands, valve 30 opens because valve body 29*d* moves away from adjustment member 25, such that valve body 29*d* is positioned above valve seat 17*a*. Similarly, when pressure-sensitive member 27 contracts, valve 30 closes because valve body 29*d* moves toward adjustment member 25, such that valve body 29*d* is positioned on valve seat 17*a*.

Valve body 29*d* also may be connected to a fifth portion/linking member 29*e* of rod member 29. Linking member 29*e* may have a diameter which is about equal to the diameter of valve body 29*d*, and may be positioned within second chamber 17 Linking member 29*e* also may be connected to a sixth portion 29*f* of rod member 29. Sixth portion 20*f* may have a diameter which is about equal to the diameter of linking member 29*e*, and is less than a diameter of through hole 21*a*. Sixth portion 29*f* also may be connected to a seventh portion 29*g* of rod member 29, and seventh portion 29*g* may be connected to an eighth portion 29*h* of rod member 29. Specifically, eighth portion 29*h* may have a diameter which is less than the diameter of sixth portion 29*f* and seventh portion 29*g* may be tapered, such that the diameter of seventh portion 29*g* decreases between sixth portion 29*f* and eighth portion 29*h*.

Figure 3:
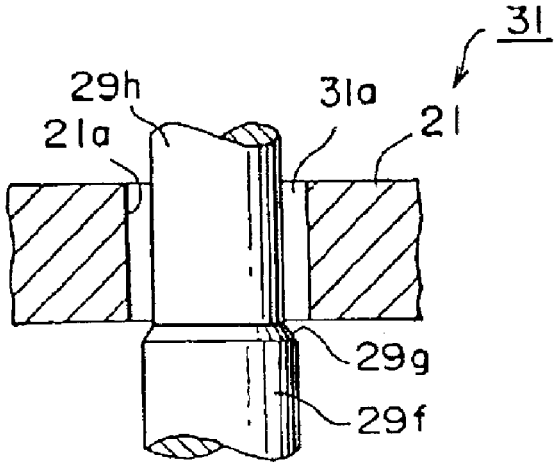
FIG. 3 is a cross-sectional view of an orifice mechanism of the compressor of FIG. 1.
Figure 4:
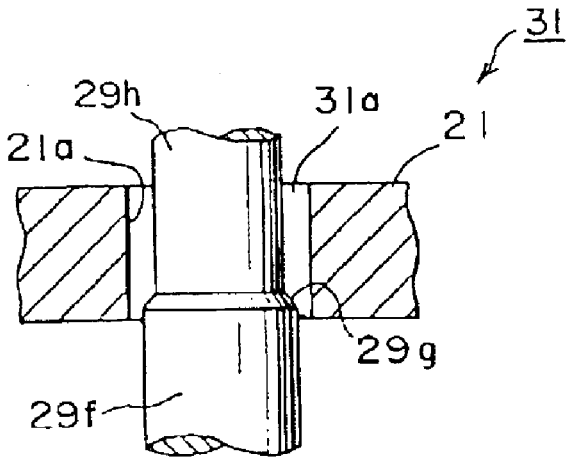
FIG. 4 is a cross-sectional view of the orifice mechanism of FIG. 3 depicting a minimum area of an opening of an annulus of the orifice mechanism.

Referring to FIGS. 3 and 4, an orifice mechanism 31 comprises sixth portion 29*f*; seventh portion 29*g*; eighth portion 29*h*, separation plate 21, and through hole 21*a* formed through separation plate 21, and an annulus 31*a* of orifice mechanism 31 is defined between rod member 29 and an interior surface of through hole 21*a*. As such, linking member 29*e* operationally couples, e.g., connects, orifice mechanism 31 to valve 30. Moreover, annulus 31*a* has a minimum area when sixth portion 29*f*, seventh portion 29*g*, and eighth portion 29*h* are positioned within through hole 21*a*. Similarly, annulus 31*a* has a maximum area when only eighth portion 29*h* is positioned within through hole 21*a*. Specifically, when pressure-sensitive member 27 expands, the area of the opening of annulus 31*a* decreases because sixth portion 29*f*, seventh portion 29*g*, and eighth portion 29*h* move away from adjustment member 25, such that sixth portion 29*f*, seventh portion 29*g*, and eighth portion 29*h* are positioned within through hole 21*a*. Similarly, when pressure-sensitive member 27 contracts, the area of the opening of annulus 31*a* decreases because sixth portion 29*f*, seventh portion 29*g*, and eighth portion 29*h* move away from adjustment member 25, such that only eighth portion 29*h* is positioned within through hole 21*a*. Referring again to FIG. 2, eighth portion 29*b* also may be connected to a ninth portion 29*i* of rod member 29. Ninth portion 29*i* may have a diameter which is about equal to the diameter of eighth portion 29*h*. Moreover, portion 29*a*–29*i* may be integrally formed.

Referring again to FIG. 2, an upper end of the second casing 15 may be sealed by a lid member 32. For example, lid member 32 may comprise a first lid member 33 and a second lid member 34, and first lid member 33 may be formed from a resin. First lid member 33 and second lid member 34 form an opening 35, and a cylindrical member 36 may be positioned within opening 35. Cylindrical member 36 may comprise a non-magnetic material, and a fixed core 37 may be fixed to, and positioned within, cylindrical member 36. Moreover, a plunger 38 may be positioned within cylindrical member 36, such that plunger 38 slides on an inner surface of cylindrical member 36. Specifically, fixed core 37 is positioned closer to orifice mechanism 31 than plunger 38. Fixed core 37 may have a through hole 37*a* formed therethrough, and ninth portion 29*i* may be positioned within through hole 37*a*. Further, plunger 38 may be fixed to ninth portion 29*i*, and a coil spring 39 and may be positioned within plunger 38. Specifically, a first end of coil spring 39 may contact plunger 38, and a second end of coil spring 39 may contact fixed core 37. A solenoid coil 40 may be arranged around cylindrical member 36, such that solenoid coil 40 is positioned between lid member 32 and a lower end of second casing 15. As such, solenoid coil 40 surrounds fixed core 37.

Fixed core 37, plunger 38, and solenoid coil 40 may form an electric solenoid mechanism. When a user selects a temperature within a automobile using compressor 100, a predetermined amount of electrical current flows into solenoid coil 40. When no current flows in solenoid coil 40, spring 39 maintains an opening of valve 30 at a maximum opening. The predetermined amount of electrical current corresponds to a temperature difference between an actual temperature within the automobile and the temperature selected by the user. The predetermined electrical current generates a predetermined amount of electromagnetic force at fixed core 37, which induces plunger 38 to move toward fixed core 37, such that plunger 38 applies a first predetermined amount of force on rod member 29. The first predetermined amount of force induces rod member 29 to move toward separation plate 25. As such, the electric solenoid mechanism biases rod member 29. Nevertheless, based on the pressure in suction chamber 42, pressure-sensitive member 27 applies a second predetermined amount of force on rod member 29. The second predetermined amount of force induces rod member 29 to move away from separation plate 25. Specifically, when the pressure in suction chamber 42 is less than a predetermined suction chamber pressure, the second predetermined amount of force is greater than the first predetermined amount of force, such that rod member 29 moves in the direction away from adjustment member 25. Consequently, valve 30 opens and the area of the opening of annulus 31*a* decreases. Similarly when the pressure in suction chamber 42 is greater than the predetermined suction chamber pressure, the first predetermined amount of force is greater than the second predetermined amount of force, such that rod member 29 moves in the direction toward adjustment member 25. Consequently, valve 30 closes and the area of the opening of annulus 31*a* increases.

In an embodiment of the present invention through hole 37*a* of fixed core 31 may have a diameter which is greater than the diameter of ninth portion 29*i*. Therefore, when plunger 38 moves within cylindrical member 36, ninth portion 29*i* does not contact fixed core 37. Moreover, sixth portion 29*f*, seventh portion 29*g*, and eighth portion 29*h* do not contact the separation plate 21.

In operation, when the pressure in suction chamber 42 is greater than the predetermined suction pressure, valve 30 is closed, and the area of the opening of annulus 31*a* is at the maximum area. Therefore, a refrigerant, e.g., a liquid refrigerant or a refrigerant gas, is introduced from crank chamber 41 into suction chamber 42 via annulus 31*a*, such that the pressure in crank chamber 41 decreases rapidly, and the pressure in suction chamber 42 increases rapidly. As a result, the inclination angle of swash plate 64 also increases rapidly. When the pressure in suction chamber 42 is less than the predetermined suction pressure, valve 30 is open and the area of the opening of annulus 31*a* is at the minimum area. Therefore, a refrigerant is introduced from discharge chamber 43 into crank chamber 41, such that the crank chamber pressure increases rapidly. Consequently, the pressure differential between the pressure in crank chamber 41 and the pressure in suction chamber 42 increases rapidly, and the inclination angle of smash plate 64 decreases rapidly. Thus, the pressure in crank chamber 41 is rapidly controlled, i.e., increased or decreased, by control valve assembly 10.

Figure 5:
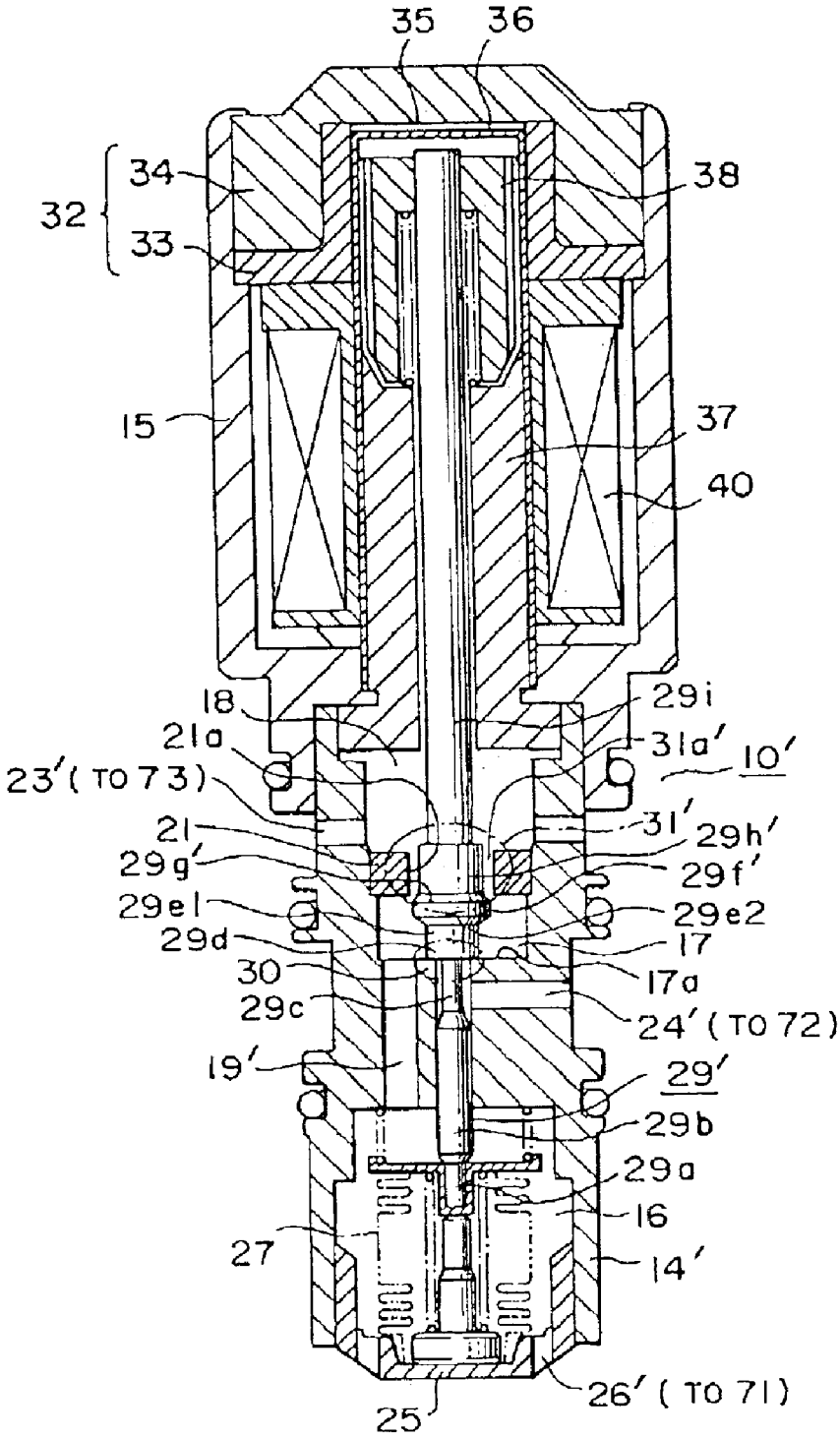
FIG. 5 is a cross-sectional view of a valve assembly of a compressor according to an embodiment of the present invention.
Figure 6:
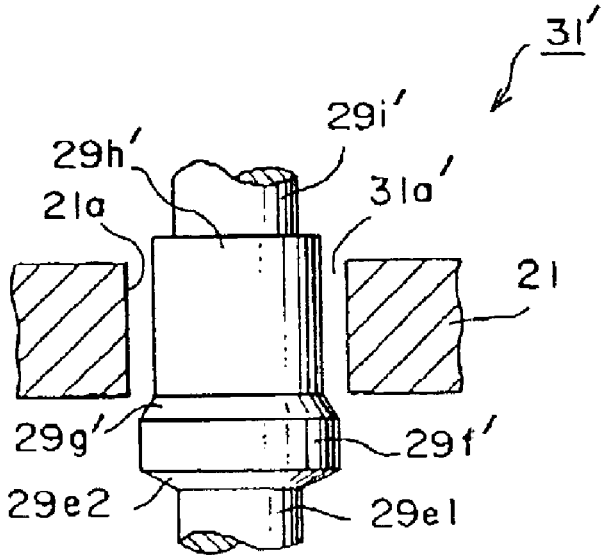
FIG. 6 is a cross-sectional view of an orifice mechanism of a compressor according to an embodiment of the present invention.
Figure 7:
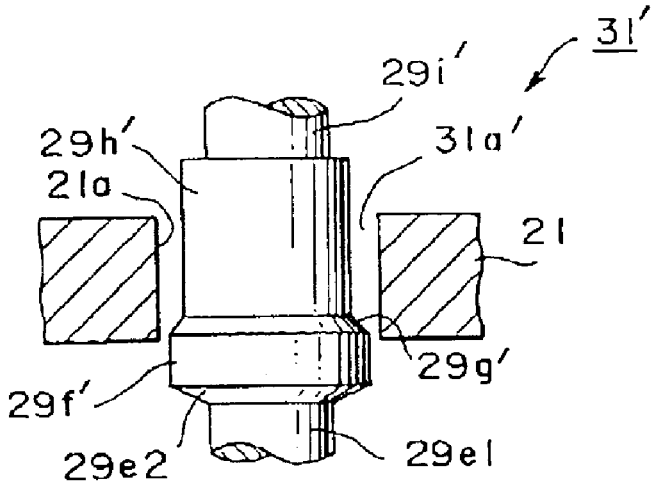
FIG. 7 is a cross-sectional view of the orifice mechanism of FIG. 6 depicting a maximum area of an opening of an annulus of the orifice mechanism.

Referring to FIGS. 5–7, a control valve assembly 10' according to another embodiment of the present invention is depicted. The features and advantages of control valve assembly 10' are substantially similar to the features and advantages of control valve assembly 10. Therefore, the features and advantages of control valve assembly 10' and control valve assembly 10, which are substantially similar, are not discussed further with respect to control valve assembly 10'. In this embodiment, the electric solenoid mechanism biases valve 30 to be closed by applying a predetermined force to valve 30, which corresponds to a predetermined crank chamber pressure.

Specifically, a linking member of a rod member 29' may comprise a first sub-portion 29*e*1 and a second sub-portion 29*e*2, and rod member 29' may comprise a sixth portion 29*f*, a seventh portion 29*g'*, and an eighth portion 29*h'*. Valve 30 and an orifice mechanism 31' may be operationally coupled, e.g., connected, to each other by first sub-portion 29*e*1 and second sub-portion 29*e*2. First sub-portion 29*e*1 may have a diameter which is about the same as a diameter of valve body 29*d*, and second sub-portion 29*e*2 may be tapered, such that the diameter of second sub-portion 29*e*2 increases between first sub-portion 29*e*1 and sixth portion 29*f'*. Moreover, the diameter of eighth portion 29*h'* may be greater than the diameter of valve body 29*d*, and an annulus 31*a'* of orifice mechanism 31' may be formed between rod member 29' and through hole 21*a*. To use control valve assembly 10', compressor 100 may be modified, such that first passage 71 and third passage 73 are connected to a third port 26' and a first port 23', respectively. Third port 26' may be in communication with first chamber 16, such that the pressure in first chamber 16 is about equal to the pressure in crank chamber 41 In this embodiment, pressure-sensitive member 27 expands and contracts in response to the pressure in crank chamber 41 instead of the pressure in suction chamber 42. Moreover, second chamber 17 may be in communication with first chamber 16 via a fourth passage 19', and first port 23' may be in communication with third chamber 18, such that the pressure in third chamber 18 may be about equal to the pressure in suction chamber 42.

In this embodiment of the present invention, when the pressure in crank chamber 41 is greater than a predetermined crank chamber pressure, valve 30 is closed and the area of the opening of annulus 31*a'* is at the maximum area. Therefore, a refrigerant is introduced from crank chamber 41 to suction chamber 42 via annulus 31*a'*. As such, the pressure in crank chamber 41 rapidly decreases, the pressure in suction chamber 42 rapidly increases, and the inclination of smash plate 64 rapidly increases. Nevertheless when the pressure in crank chamber 41 is less than the predetermined crank chamber pressure, valve 30 opens and a refrigerant is introduced from discharge chamber 43 to crank chamber 41. Moreover, the area of the opening of annulus 31*a'* is at the minimum area, such that the pressure differential between the pressure in crank chamber 41 and suction chamber 42 rapidly increases, and the inclination of swash plate 64 rapidly decreases While the invention has been described in connection with preferred embodiments, it will be understood by those skilled in the art that variations and modifications of the preferred embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. A variable displacement compressor comprising:

a suction chamber;

a discharge chamber;

a crank chamber;

a first path for allowing communication between the crank chamber and the discharge chamber;

a second path for allowing communication between the crank chamber and the suction chamber;

a valve assembly comprising a valve, wherein the valve is positioned within the first path, and the valve assembly controls a pressure in the crank chamber by varying a position of the valve;

an orifice mechanism comprising:

a plate having a hole formed therethrough; and an elongated member positioned within the hole, wherein the elongated member is movable within the hole, wherein an annulus of the orifice mechanism is defined between the elongated member and an interior surface of the hole and defines a portion of the second path, and wherein the orifice mechanism controls a flow of a refrigerant from the crank chamber to the suction chamber by varying an area of an opening of the annulus; and a linking member operationally coupling the valve assembly to the orifice mechanism.

2. The compressor of claim 1, wherein when the area of the opening of the annulus is at a minimum area, the valve is open, and when the area of the opening of the annulus is at a maximum area, the valve is closed.

3. The compressor of claim 1, wherein the valve comprises:

a valve body; and a valve seat, wherein the valve seat comprises a through hole formed therethrough, and the through hole defines a portion of the first path, wherein the valve is closed when the valve body is positioned on the valve seat, thereby covering the through hole, and wherein the valve has a maximum opening when the valve body is positioned a predetermined distance from the valve seat.

4. The compressor of claim 3, wherein as a size of the opening of the valve increases, the area of the opening of the annulus decreases, and as the size of the opening of the valve decreases, the area of the opening of the annulus increases.

5. The compressor of claim 4, wherein the valve body moves in a predetermined direction to open the valve, and the elongated member moves in the predetermined direction to decrease the area of the opening of the annulus.

6. The compressor of claim 5, wherein the linking member and the orifice mechanism are positioned within at least one housing of the valve assembly.

7. The compressor of claim 6, wherein the valve assembly comprises a particular chamber formed therein, wherein the linking member is positioned within the particular chamber, and the first path and the second path share a common path portion from the crank chamber to the particular chamber.

8. The compressor of claim 3, wherein the linking member is formed integrally with the valve body and the elongated member.

9. The compressor of claim 3, wherein the valve assembly further comprises:

a pressure-sensitive member connected to the suction chamber; and means for operationally coupling the pressure-sensitive member to the valve, wherein the pressure in the suction chamber applies a first force to the pressure sensitive member, and the first force urges the pressure-sensitive member to expand in the predetermined direction.

10. The compressor of claim 9, wherein the variable control valve assembly further comprises means for applying a second force to the pressure sensitive member, wherein the second force urges the pressure-sensitive member to contract in a direction opposite the predetermined direction.

11. The compressor 10, wherein the means for applying the second force comprises an electric solenoid mechanism operationally coupled to the valve, wherein the second force corresponds to a temperature differential between an actual temperature within an automobile using the compressor, and a user-selected temperature, wherein the second force is greater than the first force when the pressure in the suction chamber is greater than a predetermined suction pressure.

12. The compressor according to claim 11, wherein the valve assembly further comprises a spring for maintaining the opening of valve at the maximum opening when an amount of current received by the electric solenoid mechanism is about zero Amps.

13. The compressor according to claim 3, wherein the valve assembly further comprises:

a pressure-sensitive member connected to the crank chamber; and means for operationally coupling the pressure-sensitive member to the valve, wherein the pressure in the crank chamber applies a first force to the pressure sensitive member, and the first force urges the pressure-sensitive member to expand in the predetermined direction.

14. The compressor of claim 13, wherein the variable control valve assembly further comprises means for applying a second force to the pressure sensitive member, wherein the second force urges the pressure-sensitive member to contract in a direction opposite the predetermined direction.

15. The compressor 14, wherein the means for applying the second force comprises an electric solenoid mechanism operationally coupled to the valve, wherein the second force corresponds to a temperature differential between an actual temperature within an automobile using the compressor, and a user-selected temperature, wherein the second force is greater than the first force when the pressure in the suction chamber is greater than a predetermined suction pressure.

16. The compressor according to claim 15, wherein the valve assembly further comprises a spring for maintaining the opening of valve at the maximum opening when an amount of current received by the electric solenoid mechanism is about zero Amps.

* * * * *